US005263287A

United States Patent [19]

Lyons, Jr.

[11] Patent Number: 5,263,287

[45] Date of Patent: * Nov. 23, 1993

[54] ROOFING MEMBRANE FLASHING

[75] Inventor: George Lyons, Jr., Madison, Conn.

[73] Assignee: The Bilco Company, West Haven, Conn.

[ * ] Notice: The portion of the term of this patent subsequent to Jul. 17, 2007 has been disclaimed.

[21] Appl. No.: 730,661

[22] Filed: Jul. 16, 1991

[51] Int. Cl.[5] ..... E04D 13/14

[52] U.S. Cl. ..... 52/58; 52/395

[58] Field of Search ..... 52/58, 59, 62, 300, 52/96, 718.1, 395

[56] References Cited

U.S. PATENT DOCUMENTS

| | | | |
|---|---|---|---|
| 2,702,514 | 2/1955 | Dalley | 52/62 X |
| 2,755,484 | 7/1956 | Hotz | 52/59 X |
| 3,187,464 | 6/1965 | Sharp | 52/300 X |
| 4,700,512 | 10/1987 | Laska | 52/96 X |
| 4,941,300 | 7/1990 | Lyons, Jr. . | |

FOREIGN PATENT DOCUMENTS

| | | | |
|---|---|---|---|
| 2611182 | 9/1977 | Fed. Rep. of Germany | 52/58 |

*Primary Examiner*—Carl D. Friedman
*Assistant Examiner*—Creighton Smith
*Attorney, Agent, or Firm*—DeLio & Peterson

[57] ABSTRACT

A flashing for sealing a waterproof roofing membrane to a vertical wall such as a parapet wall around the roof, including an elongated mounting flange for connection to the wall, a top flange and wall flange which define a filler channel with the vertical wall. An elongated elastromeric filler piece is adapted to fit closely within the filler channel with an overlapped portion of the roofing membrane for a temporary adjustable hold on the roofing membrane. A set of finger like tabs preferably punched out of the wall flange may be bent into the filler channel beneath the membrane and filler piece to hold it securely therein. Alternative embodiments for use with pre-existing walls and for attachment to a brick and motar wall at the time of construction are shown, as are corner pieces for sealing inside and outside corners.

24 Claims, 2 Drawing Sheets

Fig. 2.
Fig. 1.
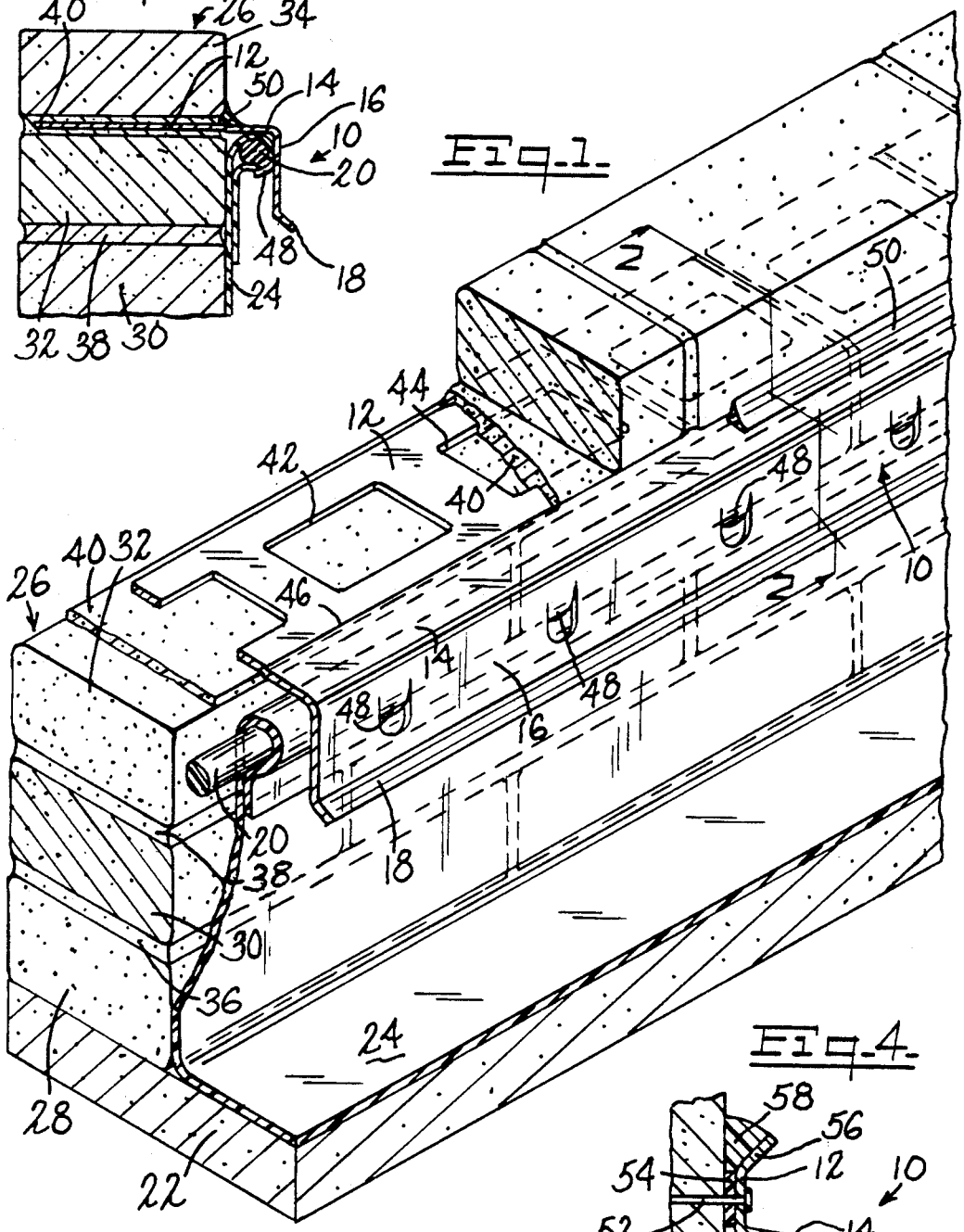
Fig. 4.
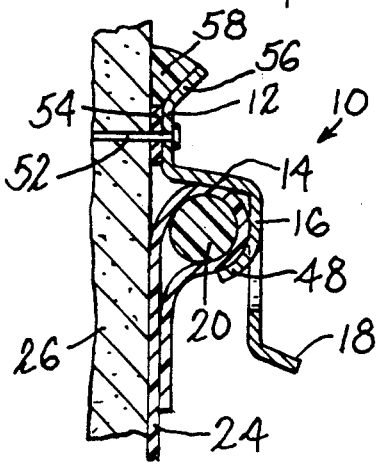

ROOFING MEMBRANE FLASHING

BACKGROUND OF THE INVENTION

1. Field of the Invention

This invention relates to a flashing for sealing between a waterproof roofing membrane and a vertical wall such as the parapet wall surrounding flat industrial roofs. More particularly, this invention relates to a flashing which may be installed before the roofing membrane is installed and which facilitates rapid connection to form a watertight seal between the roofing membrane and the wall.

2. Related Art

Waterproof roofing membranes are commonly used to provide a long-lasting leakproof roof, particularly for flat or mildly sloped roofs such as are found on warehouses, factories, supermarkets, malls and other large commercial and industrial buildings. To increase safety for individuals who may be required to work on the flat roof, the perimeter of the roof on such structures is often surrounded by a low parapet wall. However, such a wall presents difficulties when installing the roofing membrane. Even where the roofing membrane is unbroken, wind-driven rain and snow may enter gaps between the wall and the membrane when installed with prior art methods.

Previously, roofing membranes have been connected to the vertical wall by bringing the membrane up the parapet wall from the roof to a height above that of snow accumulation and fastening it at intervals by screws, nails or the like, either directly through the membrane or more commonly through a stiffener, such as a strip of rigid material.

In order to obtain a good waterproof seal between the membrane and the vertical wall, the fasteners must be very closely spaced. Not only is it time consuming to apply the required number of fasteners, but even when stiffeners are used, after a period of time, the weight of the membrane and the effects of wind and vibration may cause a small gap to appear between the connection points which permits rain to enter between the face of the vertical wall and the roofing membrane.

Moreover, with previous installation methods the fasteners must be applied through the roofing membrane which means that the membrane must be punctured and that this step must occur at the same time that the roofing membrane is being installed. If a stiffener is used, both the stiffener and the membrane must simultaneously be held in position against the wall and in the correct relationship as the fasteners are applied.

Using such methods, it has been difficult to obtain the proper alignment of the membrane on the roof with the stiffener and the membrane against the vertical wall, and to apply the fasteners to make a permanent connection. Once installed, the fasteners penetrate the membrane and further adjustments of the position of the membrane are difficult.

A further problem with previous methods has been that individual fasteners, such as the screws or nails used to attach the membrane to the parapet wall, are occasionally dropped between the membrane and the parapet wall during installation of the membrane. Ultimately, the sharp surfaces on such trapped fasteners may puncture the membrane leading to leaks.

In contrast, with the present invention the flashing is installed at any convenient time, for example when the parapet wall is being constructed. This allows the work of installing the membrane to proceed without interfering with the installation of the membrane, and any misplaced fasteners used in installing the flashing of this invention may be cleared away, and are not likely to be trapped underneath the membrane.

When the membrane is to be installed, it can temporarily be held in the flashing of this invention while the roofing membrane is adjusted, wrinkles and pockets smoothed out, and cuts made for roof openings, etc. Because the temporary hold does not damage the membrane, if necessary, the membrane may be shifted in the flashing. Once the proper alignment of all parts of the membrane has been achieved, the temporary connection may rapidly be made more secure using a punch to bend tabs which hold the membrane to the flashing. However, the tabs may later be unbent to remove the membrane for repair or replacement, or to access the roof underneath. The tabs permit the membrane to be installed without using separate fasteners which slow the operation and risk damage to the waterproof integrity of the membrane.

In one form, the flashing may be installed when a brick and mortar wall is constructed. In an alternative form, the flashing may be installed to an existing vertical wall. In either case, it may be installed well in advance of the roofing membrane.

The roofing membrane flashing of this invention is designed to permit an extremely rapid connection between the roofing membrane and a vertical wall to produce the desired watertight seal. Moreover, the design of the present invention completely covers the gap between the roofing membrane and the face of the vertical wall so that spaces do not develop over time between the wall and the membrane.

Accordingly, one object of the present invention is to provide a flashing which may be installed prior to the installation of the roofing membrane. A second object of the invention is to provide a roofing membrane flashing which may be installed in a brick and mortar wall at the time the wall is to be constructed. Yet another object of the invention is to provide a flashing which requires no separate fasteners to be handled when the membrane is attached. Still another object of the invention is to provide a flashing system which may be formed from an initially flat sheet stock material by bending. A further object of the invention is to provide a corner piece to provide a simple seal between two flashings at an inside or outside corner. Yet another object is to provide a flashing which will provide a first temporary non-damaging grip on the membrane which may be adjusted before making the seal permanent.

SUMMARY OF THE INVENTION

The above and other objects which will be apparent to those skilled in the art are achieved in the present invention which provides a flashing for sealing a roofing membrane to a vertical wall. The flashing comprises an elongated mounting flange adapted for watertight attachment to the vertical wall, a top flange connected to the mounting flange which extends outwardly from the vertical wall when the mounting flange is attached thereto and a wall flange which extends downwardly from the top flange. The top flange and wall flange define a filler channel with the vertical wall when the mounting flange is attached thereto.

An elongated filler piece is provided which fits closely within the filler channel. A portion of the roofing membrane is wrapped up and over the filler piece and the membrane-wrapped filler piece is inserted into the filler channel where it fits closely providing a temporary friction hold. The wall flange has a plurality of tabs which are preferably punched out of the wall flange and are initially approximately parallel to the wall flange, to permit the filler piece and lapped roofing membrane to be inserted into the filler channel. The tabs are bendable such that the end of each tab projects into the filler channel beneath the filler piece to retain the filler piece and the overlapped membrane within the filler channel.

Prior to bending the tabs into the filler channel, the lapped membrane and the filler piece, which is preferably elastomeric, comprise a compressible unit which is temporarily held in the filler channel by friction. The position of the membrane may be adjusted as necessary during installation to provide a perfect fit between the membrane, the roof and the wall. Once the fit is adjusted, the tabs are quickly bent into the filler channel beneath the filler piece and lapped membrane to provide a "permanent" hold, which may be released by unbending the tabs.

In a preferred embodiment, the mounting flange extends horizontally and is adapted for installation into a brick and mortar wall during construction of the wall. The mounting flange includes a plurality of spaced openings which are adapted to engage mortar, thereby locking the mounting flange into the mortar seam. The spaced openings preferably comprise at least 10% of the surface area of the mounting flange held within the mortar, and more preferably at least 40% of the surface area of the mounting flange, to permit a solid connection between the mortar and the bricks above the mounting flange. In this embodiment, the top flange is preferably an integral horizontal extension of the mounting flange which simplifies the corner connections at inside or outside corners of the parapet wall.

In a second embodiment of the invention, the mounting flange extends vertically and is adapted for connection directly to the face of the vertical wall. In this embodiment, a sealant flange is provided along the upper edge of the mounting flange providing a V-shaped groove into which a bead of sealant may be applied to form a long lasting waterproof seal.

With either embodiment. a drip edge flange may be provided extending outwardly from the wall flange to prevent moisture from running up into the filler channel.

BRIEF DESCRIPTION OF THE DRAWINGS

The preferred embodiments of the invention are shown in the accompanying drawings wherein:

FIG. 1 is a perspective view of a first embodiment of the invention showing the flashing installed in a brick and mortar wall, with portions of the flashing, roofing membrane, mortar and bricks being cut away in stepped layers for greater clarity.

FIG. 2 is a side view of the embodiment in FIG. 1, in section, along section lines 2—2 in FIG. 1.

FIG. 4 is a side view of the embodiment in FIG. 3, in section, along section lines 4—4 in FIG. 3.

DETAILED DESCRIPTION OF THE INVENTION

Figure 3:
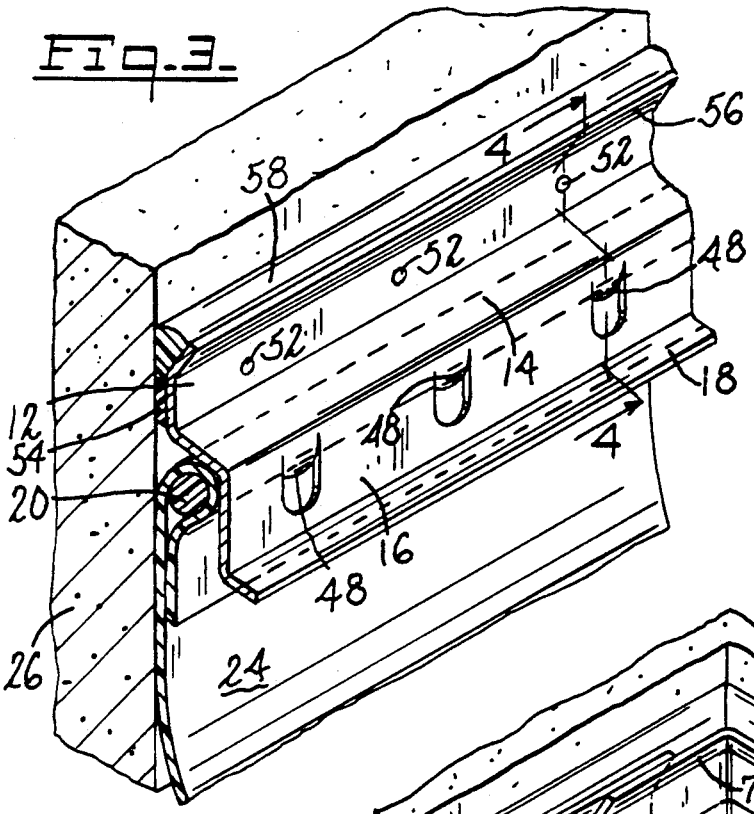
FIG. 3 is a perspective view of a second embodiment of the invention suitable for installation on preexisting vertical walls, showing the flashing installed on a concrete parapet wall.

In FIGS. 1 and 2 a preferred embodiment of the flashing of the present invention is generally referred to with reference numeral 10. The flashing is shown installed in a brick and mortar wall, with portions of the bricks, mortar, flashing and roofing membrane being cut away in layers to show the construction. The flashing 10 includes an elongated mounting flange 12, a top flange 14, a wall flange 16, a drip flange 18 and an elongated filler piece 20.

The embodiment seen in FIGS. 1 & 2 is designed for installation into the mortar seam of the wall at the time the wall is constructed. A roof 22 is covered by a waterproof roofing membrane 24 which is connected to the brick and mortar parapet wall 26 via the flashing 10 of the present invention. The parapet wall 26 comprises courses of bricks 28, 30, 32 and 34 separated by mortar seams 36, 38 and 40.

Mounting flange 12 extends horizontally into mortar seam 40, as may be seen in FIG. 1 where the mortar has been cut away for clarity to show the mounting flange. The mounting flange includes a plurality of spaced openings 42, 44 which engage the mortar in the seam 40 between brick layers 32 and 34. Brick layer 34 has also been cut away in FIG. 1 as has the end of the flashing 10.

The manner in which the mounting flange is engaged by and embedded in the mortar seam 40 is shown in greater detail in FIG. 2 which is taken along the section lines 2—2 in FIG. 1.

In order to provide a good connection between the mounting flange 12 and the mortar seam in which it is locked, it has been found preferable for the openings 42, 44 to comprise at least 10% and preferably at least 40% of the surface area of the mounting flange 12 embedded in the mortar.

Greater percentages of the surface area of the mounting flange may be opened to engage the mortar, provided that sufficient strength is retained in the mounting flange, particularly in the region near the face of the wall, so that the flange remains rigid. It is preferable for a region of the mounting flange adjacent to the top flange to be unbroken and without openings to maximize this rigidity when the flashing is mounted.

In the embodiment seen in FIG. 1, the mounting flange is horizontal and the top flange is connected along its edge. The top flange extends horizontally outward from the vertical wall.

To assist in properly aligning the flange with the brick wall, a marker means 46 is provided which is lined up with the inner face of the parapet wall 26 when the flashing is installed. The marker means may comprise a painted line, or it may be a slight linear indentation or impression formed at the time the flashing is manufactured.

As can be seen in FIG. 2, the top flange 14 is substantially horizontal, which makes it possible for the flashing to be applied to inside and outside corners merely by overlapping or butting the edges of the flashing as needed.

The top flange 14 is connected along its outer edge to the wall flange 16 which extends downwardly from the top flange in a direction which roughly parallels the face of the parapet wall 26. The wall flange 16 and the top flange 14, in combination with the parapet wall 26, define a filler channel, i.e., the space below the top flange and between the wall flange and the vertical wall 26.

The wall flange 16 includes a plurality of tabs 48. Preferably the tabs are formed by punching a small finger-shaped portion out of the wall flange 16, leaving the upper portion of the finger connected to the wall flange 16, and freeing the other three sides. The tab is punched just far enough so that it is free of the wall flange, but remains parallel to it and clear of the filler channel, thereby allowing the membrane and filler piece to be inserted. The tab is then bendable along the side that remains attached to the wall. After bending, the free end of the tab projects into the filler channel to hold the membrane.

The flashing 10 is installed at the time the parapet wall 26 is constructed and is ready for use by the installer of the membrane roofing material 24. The membrane 24 is laid across the surface of the roof 22 and brought up the vertical face of the parapet wall 26 and into the filler channel. A filler piece 20, which is preferably an extruded rod of elastomeric material such as an inexpensive crosslinked polyethylene, is pushed up into the filler channel with the membrane 24 wrapped up, over and down in front of the filler piece 20.

The size of the filler piece is selected so that the wrapped membrane in combination with the resilient filler piece is slightly larger in diameter than the filler channel. When the membrane is inserted into the channel, the filler piece is slightly compressed which retains the membrane temporarily in the filler channel. The membrane may be completely inserted into the channel, then adjustments in position may be made as needed.

The tabs 48 which are initially substantially parallel to the wall flange 16, are then bent into the filler channel by the installer who can proceed quickly down the row bending each tab into the channel beneath the membrane and filler piece to effect a long term attachment. However, if it ever becomes necessary to replace the roofing membrane, the tabs can be bent out of the filler channel as needed to release the membrane.

The top flange 14 is preferably horizontal in order to facilitate overlapping of the flanges at inside and outside corners. However, rain and/or snow may have a tendency to sit on the horizontal top flange and seep into the mortar seam 40. To prevent damage to the mortar seam from this effect, in freezing climates it is preferable to provide a bead of sealant 50, such as a roof caulk, silicone sealant or the like, between the upper surface of the top flange 14 and the face of the parapet wall 26. The optional drip flange 18 is provided to further assist in preventing water from moving up under the flange.

FIGS. 3 and 4 show an alternative embodiment of the invention wherein like numerals indicate like elements of the invention as described above. In this embodiment, the mounting flange 12 extends vertically and is attached to the face of a pre-existing vertical wall, such as a poured concrete wall, by means of fasteners 52 which are typically power driven nails. The fasteners penetrate holes in the mounting flange 12 and project into the vertical face of the wall 26.

As may be seen in FIG. 4, the mounting flange 12 is provided with a resilient gasket 54 between the mounting flange and the parapet wall 26. This gasket 54, which is preferably made of EPDM, forms a waterproof seal between the mounting flange 12 and the rough surface of the wall 26. EPDM is an abbreviation for a terpolymer elastomer made from an ethylene-propylene diene monomer. This gasket seal is further improved by the use of a sealant flange 56 which connects to the mounting flange 12 and projects outwardly from the wall 26. The angular gap between the wall 26 and sealant flange 56 is filled with a bead of sealant 58 similar to the sealant material 50 described in connection with the embodiment shown in FIGS. 1 and 2.

From the cross sectional side views of FIGS. 2 and 4 it can be seen that the flashings of the present invention may be formed by bending the flange to shape and punching the desired holes from an initially planar piece of sheet stock material. As those familiar with the art will recognize, a construction which may be manufactured by bending and punching from sheet stock is particularly economical to make as compared to comparable flashings produced by extrusion. Nonetheless, the present invention may be also be manufactured by extrusion.

To resist weather, and in particular to resist the corrosive effects of the mortar in the embodiments seen in FIGS. 1 and 2, the flashing of the present invention is preferably made from a corrosion resistant material such as aluminum, copper, stainless steel, galvanized steel and/or a corrosion resistant coated aluminum, for example, EPDN coated aluminum.

As can be seen in FIGS. 3 and 4, the embodiment shown there has an angled sealant flange and a downward angle on the top flange 14. The angle of these flanges makes it difficult to achieve a good overlap connection between adjacent flashings on inside and outside corners as may be made with the embodiment in FIGS. 1 and 2. To make such a corner, the flashings must either be mitered and sealed at the corner, or separate corner pieces for inside and outside corners as seen in FIGS. 5 and 6 may be used.

Figure 5:
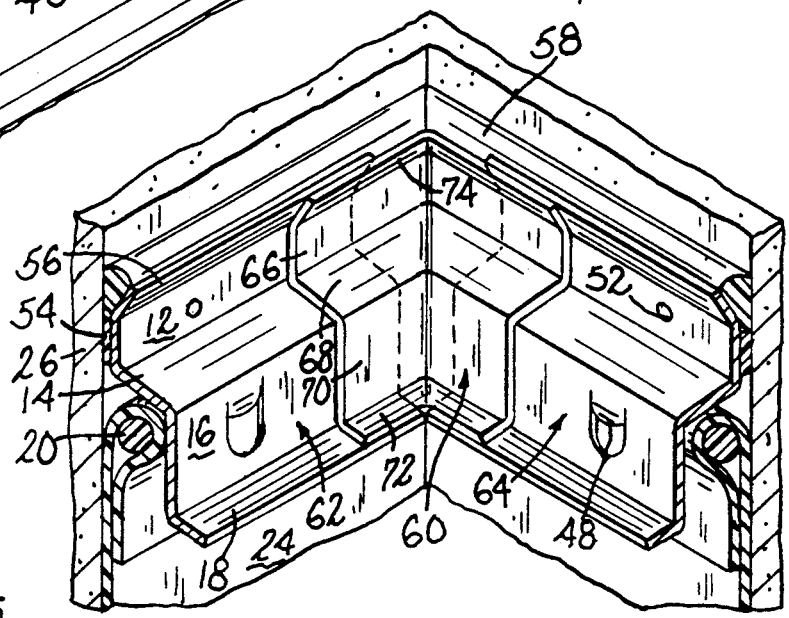
FIGS. 5 and 6 show corner pieces used to seal the inside and outside corners, respectively, between two flashing strips of the type shown in FIG. 3.
Figure 6:
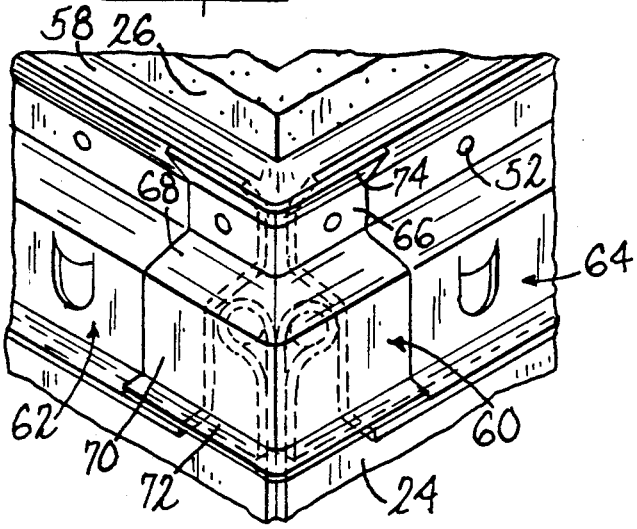

The corner pieces of FIGS. 5 and 6, are designed to seal the corner between first and second roofing membrane flashings of the type seen in FIGS. 3 and 4. The corner pieces comprise two halves which are mirror images of one another, each half being connected to the other at a mitered angle thereto. For example, in FIG. 5 the corner piece 60 seals an inside corner between flashings 62 and 64. Corner piece 60 comprises identical left and right half pieces mitered together at an inside 90° angle. Each half of the corner piece comprises a corner piece mounting flange 66, a corner piece top flange 68 and a corner piece wall flange 70.

Preferably, the corner pieces also include corresponding drip flanges 72 and sealant flanges 74.

In the preferred embodiment, the corner pieces are manufactured as integral one piece components. For example, they may be manufactured by injection molding plastic which may be adhesively attached to the flashings 62, 64, or they may be manufactured by stamping a piece of sheet metal which may then be attached with fasteners or the like as is seen in FIG. 6 illustrating an outside corner. Alternatively, the fasteners may be power driven nails projected through the corner piece mounting flanges. Adhesive and/or sealants may be used between the back of the corner piece and the matching flanges on the pieces 62, 64 and sealant is applied above the sealant flange on the corner piece to provide a watertight seal.

It will thus be seen that the objects set forth above, among those made apparent from the preceding description, are efficiently attained, and since certain changes may be made in the above article without departing from the spirit and scope of the invention, it is intended that all matter contained in the above description and shown in the accompanying drawing(s) shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

What is claimed is:

1. A flashing for sealing a roofing membrane to a vertical wall comprising:

an elongated mounting flange adapted for watertight attachment to the vertical wall;

a top flange connected to the mounting flange and extending outwardly from the vertical wall when the mounting flange is attached thereto;

a wall flange extending downwardly from the top flange, the top flange and wall flange defining a filler channel with the vertical wall when the mounting flange is attached thereto;

an elongated elastomeric filler piece adapted to fit closely within the filler channel with an overlapped portion of the roofing membrane; and a plurality of tabs connected to the wall flange, each tab being bendable to project an end of the tab into the filler channel beneath the filler piece to retain the filler piece and the overlapped membrane within the filler channel.

2. A flashing for sealing a roofing membrane to a vertical wall according to claim 1 wherein the mounting flange extends horizontally and is adapted for installation into a mortar seam in a brick and mortar wall.

3. A flashing for sealing a roofing membrane to a vertical wall according to claim 2 wherein the mounting flange includes a plurality of spaced openings adapted to engage mortar and lock the mounting flange into the mortar seam.

4. A flashing for sealing a roofing membrane to a vertical wall according to claim 3 wherein the flashing is made of a material selected from the group consisting of aluminum, copper, stainless steel, galvanized steel and corrosion resistant coated aluminum.

5. A flashing for sealing a roofing membrane to a vertical wall according to claim 4 wherein the corrosion resistant coating on the aluminum is plastic.

6. A flashing for sealing a roofing membrane to a vertical wall according to claim 4 wherein the coating on the aluminum is EPDM.

7. A flashing for sealing a roofing membrane to a vertical wall according to claim 3 wherein the top flange is an integral horizontal extension of the mounting flange.

8. A flashing for sealing a roofing membrane to a vertical wall according to claim 7 further comprising a marker means between the top flange and the mounting flange adapted to facilitate alignment of the marker means with a vertical face of the vertical wall.

9. A flashing for sealing a roofing membrane to a vertical wall according to claim 7 further comprising a drip edge flange extending outwardly from the wall flange.

10. A flashing for sealing a roofing membrane to a vertical wall according to claim 7 wherein the flashing is one piece and is formed by bending and punching from an initially planar sheet stock.

11. A flashing for sealing a roofing membrane to a vertical wall according to claim 7 wherein the spaced openings in the mounting flange comprise at least 10% of the surface area of the mounting flange to engage the mortar therein.

12. A flashing for sealing a roofing membrane to a vertical wall according to claim 11 wherein the spaced openings in the mounting flange comprise at least 40% of the surface area of the mounting flange.

13. A flashing for sealing a roofing membrane to a vertical wall according to claim wherein the mounting flange extends vertically and is adapted for attachment to a vertical face of the vertical wall.

14. A flashing for sealing a roofing membrane to a vertical wall according to claim 13 wherein the flashing is made of a material selected from the group consisting of aluminum, copper, stainless steel, galvanized steel and corrosion resistant coated aluminum.

15. A flashing for sealing a roofing membrane to a vertical wall according to claim 14 wherein the corrosion resistant coating on the aluminum is EPDM.

16. A flashing for sealing a roofing membrane to a vertical wall according to claim 13 further comprising a drip edge flange extending outwardly from the wall flange.

17. A flashing for sealing a roofing membrane to a vertical wall according to claim 13 further comprising a sealant flange extending upwardly from the mounting flange, the sealant flange being adapted to receive a continuous bead of sealant between the sealant flange and the face of the vertical wall.

18. A flashing for sealing a roofing membrane to a vertical wall according to claim 17 further comprising a drip edge flange extending outwardly from the wall flange.

19. A flashing for sealing a roofing membrane to a vertical wall according to claim 18 wherein the flashing is one piece and is formed by bending and punching from an initially planar sheet stock.

20. A flashing for sealing a roofing membrane to a vertical wall according to claim 19 further comprising a gasket positioned between the mounting flange and the vertical wall.

21. A first roofing membrane flashing according to claim 1 further including a corner piece for sealing the corner between the first roofing membrane flashing and a second roofing membrane flashing, substantially identical to the first roofing membrane flashing, the corner piece comprising:

a first half of the corner piece including:

a corner piece mounting flange adapted for connection to the mounting flange on the first roofing membrane flashing, a corner piece top flange extending outwardly from the corner piece mounting flange, and a corner piece wall flange extending downwardly from the corner piece top flange, the corner piece top flange and corner piece wall flange defining a continuation of the filler channel from the first roofing membrane flashing; and a second half of the corner piece formed as a substantially identical mirror image of the first half, the second half being integrally connected to the first half at a mitred angle to the first half, the corner piece mounting flange of the second half being adapted for connection to a mounting flange on the second roofing membrane flashing and the corner piece top flange and corner piece wall flange of the second half of the corner piece defining a continuation of a filler channel in the second roofing membrane flashing.

22. A corner piece for sealing the corner between two roofing membrane flashings according to claim 21 further comprising a corner piece drip edge flange on each half extending outwardly from the corner piece wall flange on each half.

23. A corner piece for sealing the corner between two roofing membrane flashings according to claim 21 further comprising a corner piece sealant flange on each half extending upwardly from the corner piece mounting flange on each half.

24. A corner piece for sealing the corner between two roofing membrane flashings according to claim 21 wherein the corner piece is made of plastic.

* * * * *